US008763921B2

(12) United States Patent
Boesterling et al.

(10) Patent No.: US 8,763,921 B2
(45) Date of Patent: Jul. 1, 2014

(54) DEVICE FOR MOUNTING RAILROAD TRACKS ON A SUBSTRUCTURE

(75) Inventors: Winfried Boesterling, Neuenrade (DE); André Hunold, Werdohl (DE)

(73) Assignee: Vossloh Werke GmbH, Werdohl (DE)

( * ) Notice: Subject to any disclaimer, the term of this patent is extended or adjusted under 35 U.S.C. 154(b) by 469 days.

(21) Appl. No.: 13/059,015

(22) PCT Filed: Aug. 14, 2008

(86) PCT No.: PCT/EP2008/060680

§ 371 (c)(1),
(2), (4) Date: May 9, 2011

(87) PCT Pub. No.: WO2010/017843

PCT Pub. Date: Feb. 18, 2010

(65) Prior Publication Data

US 2011/0204154 A1 Aug. 25, 2011

(51) Int. Cl.
*E01B 9/38* (2006.01)
*E01B 9/68* (2006.01)

(52) U.S. Cl.
USPC ..... 238/265; 238/283

(58) Field of Classification Search
USPC ..... 238/264, 265, 269, 272, 278, 283, 287, 238/297, 298, 306
See application file for complete search history.

(56) References Cited

U.S. PATENT DOCUMENTS

| | | | | |
|---|---|---|---|---|
| 2,950,057 | A * | 8/1960 | Speer | 238/8 |
| 3,576,293 | A * | 4/1971 | Landis et al. | 238/287 |
| 4,494,695 | A * | 1/1985 | Sonneville | 238/265 |
| 4,844,338 | A * | 7/1989 | Bucksbee | 238/283 |
| 5,203,501 | A * | 4/1993 | Vanotti | 238/265 |
| 6,880,764 | B2 * | 4/2005 | Schwarzbich | 238/287 |
| 2006/0054714 | A1 * | 3/2006 | Burger | 238/29 |

FOREIGN PATENT DOCUMENTS

| | | | |
|---|---|---|---|
| CN | 2885923 | Y | 4/2007 |
| DE | 4406105 | A1 | 8/1995 |
| DE | 29520973 | U1 | 8/1996 |
| WO | 2007082553 | A1 | 7/2007 |

* cited by examiner

*Primary Examiner* — Zachary Kuhfuss
(74) *Attorney, Agent, or Firm* — Sughrue Mion, PLLC

(57) ABSTRACT

The invention relates to a device for mounting rail-road tracks (22) on a substructure (20; 20*a*, 20*b*), comprising two angle guide elements (30; 30*a*, 30*b*) disposed on both sides of the rail foot (22*a*) for each mounting point, and one support element (28) on the side facing away from the rail foot (22*a*) of each angle guide element (30, 30*a*, 30*b*), and a support unit (26) disposed beneath the angle guide element (30; 30*a*, 30*b*) and support elements (28) of the mounting point and comprising two threaded bolts (42) for tightening rail clamps (32), disposed such that they extend through openings in the angle guide plates (30; 30*a*, 30*b*) in the installed state.

13 Claims, 5 Drawing Sheets

DEVICE FOR MOUNTING RAILROAD TRACKS ON A SUBSTRUCTURE

This is a National Stage Entry of Application No. PCT/EP2008/060680 filed Aug. 14, 2008, filed in German, and the contents of which are incorporated herein by reference in their entirety.

FIELD OF AND BACKGROUND OF THE INVENTION

The invention relates to a device for mounting railroad tracks on a substructure and a railroad sleeper in the turnout area having this type of device as well as a fixed track for a section of railroad comprising carriers with this type of device.

Special rail mountings are required in the turnout area because, similar to a fixed track, no sleepers profiled on their upper side can be used. Such profiled sleepers would be useful since, on the one hand, they fix the axial position of the rail mounting in the longitudinal direction of the sleeper, and on the other, allow transverse forces to be introduced into the sleeper by means of corresponding profiling.

Both in the turnout area and on carriers of a fixed track the rails must be mounted on a substantially level subsurface. Moreover, one strives to be able to assemble rail mountings both in the turnout area and on a fixed track with the least possible complexity.

FIG. 4 shows the Vossloh 300w rail mounting system known from the prior art wherein a total of four mounting screws and corresponding plugs are used at each mounting point. Located on both sides of the rail 11 are angle guide plates 7 which are respectively held on the side facing away from the rail by a support angle 2 which is fixed by means of a sleeper screw 4 to a spring ring 3. Here the sleeper screw 4 engages with a screw plug 1. The angle guide plates 7 are used for the precise positioning of tensioning clamps 9, the one on the right in FIG. 4 being shown in the pre-assembly position, and the one on the left being shown in the installed position. Every tensioning clamp is fixed to a washer by means of a further sleeper screw 10 and also engages with a screw plug 1. Depending on the required spring compression values for the rail head an elastic intermediate plate 5, a base plate 6 and a further plastic intermediate layer 8 can additionally be disposed between the rail foot and the concrete base layer 12. With the mounting shown in FIG. 4 four plugs must be provided in the substructure for the four sleeper screws shown. For this reason the assembly of the rail mounting shown in FIG. 4 is very complex.

The rail mounting on a fixed track shown in FIG. 5 has a similar structure in some areas to the rail mounting shown in FIG. 4, and so in the following one will only discuss the differences. In the example according to FIG. 5, which corresponds to the Vossloh DFF 300-1 system rail mounting a base plate 13 is provided which can be connected securely to an intermediate plate 15, e.g. is stuck to the latter. The unit comprising the base plate 13 and the intermediate plate 15 is screwed with the aid of mounting screws 16 through a bottom casting layer 17 into the base layer 18 of the fixed track, and is secured. With the aid of hook bolts 19 which are fitted in the base plate 13 the angle guide plates 7 and the tensioning clamps 9 are fastened, a fastening nut 14 being used on the threaded bolts of the hook bolt 19 in order to fix and tighten the tensioning screw.

The construction shown in FIG. 5 also requires increased assembly complexity since all four screws must be fixed at the assembly location, only the mounting screws 16 having to be fixed in the substructure, however.

OBJECTS AND SUMMARY OF THE INVENTION

One object of the invention is to provide a device for mounting railroad tracks on a substructure which has greater variability and is easy to assemble.

The device according to the invention for mounting railroad tracks on a substructure comprises two angle guide elements for each mounting point disposed on both sides of the rail foot, and one support element respectively on the side of each angle guide element facing away from the rail foot. Furthermore, a support unit disposed beneath the angle guide elements and support elements of the mounting point and two threaded bolts for tightening tensioning clamps are provided, the threaded bolts being arranged such that they extend through openings in the angle guide plates in the installed state.

In other words, the support unit disposed beneath the angle guide elements and support elements carries the whole rail mounting by on the one hand the support unit having dimensions such that it carries both the angle guide elements and support elements from the side of every angle guide element facing away from the rail foot, and also having two threaded bolts which in the installed state extend through openings in the angle guide plates and serve to mount and tighten tensioning clamps. In this way the device according to the invention can be pre-assembled on the rail or sleeper, and after placing onto the substructure in the form of a sleeper in the turnout area or a carrier of a fixed rail need only be connected to the substructure.

Preferably the tensioning clamps are substantially W-shaped, the central loop of which partially surrounds the shaft of the threaded bolts and comes to rest against the angle guide element. In addition to the good elastic properties due to the W-shape, an advantage of this type of tensioning clamp is that in the pre-assembled state the tensioning clamp is attached undetachably to the pre-assembly unit because the latter encompasses the threaded bolt with its central loop sufficiently tightly such that the latter can not detach itself.

Preferably the device further comprises two sleeper screws or bolt connections which respectively pass through one of the support elements and through a through-hole in the support unit. With the aid of these sleeper screws or bolt connections the whole assembly according to the invention can be mounted on a suitable substructure. No additional screws are needed which must either be anchored into the substructure according to the prior art shown in FIG. 4, or which must be hooked on separately according to the prior art shown in FIG. 5, and only secured in position after fixing under tension.

According to one preferred embodiment the support elements have a mounting contour, preferably a clip mechanism, which interacts with a complementarily formed attachment contour of the support unit in order to attach the support elements to the support unit in the pre-assembly position. This measure constitutes a simple alternative in order to also connect the support elements to the support unit in the pre-assembly position. Alternatively, however, the sleeper screw/bolt connection could also be configured such that it can e.g. be screwed into threads in the support unit and in this way the desired pre-assembly of the support elements can also be implemented. Preferably a clip mechanism can be provided which within the framework of pre-assembly requires a particularly small amount of complexity and also need only offer sufficient stability during the pre-assembly phase. Alternatively to a clip mechanism the mounting of the support elements on the support unit could also be realised by means of a mushroom contour.

Preferably the device further comprises projections on the support unit which in the installed position extend upwards and have locating surfaces for resting against counter surfaces of the support elements on the side of the respective support element facing away from the angle guide element. These types of projection can be in the form, for example, of one-piece ribs which are orientated in the longitudinal direction of the rail and serve to introduce transverse forces occurring via the rail foot and by interconnecting the angle guide element and the support element into the support unit and from there into the substructure. Therefore the projections replace the inclined shoulder region for bearing the angle guide elements provided with standard sleepers. Finally, the projections also serve to prevent unintentional turning of the support elements.

According to one preferred embodiment the threaded bolts are welded to the support unit. In this way, within the framework of the assembly there is already a smaller number of components to be assembled and in addition, when screwing on a fixing nut, the threaded bolt can be prevented from also turning relative to the support unit. Alternatively, it is also possible, however, to use the threaded bolts in the form of countersink screws which can be inserted into the support unit from the side facing away from the angle guide elements in the installed position. It is an advantage with conventional countersink screws that on the one hand they do not project over the lower side surface of the support unit, and on the other hand, due to their conically formed head, have a large friction surface in relation to the support unit which also helps to prevent undesired turning of the threaded bolts relative to the support unit.

The device according to the invention preferably further comprises at least one elastic intermediate layer between the angle guide elements, the at least one elastic intermediate layer serving to bear the rail. By appropriately selecting one or more elastic intermediate layers, and by appropriately selecting a material suitable for this on the one hand the required rail head spring compression can be guaranteed, but on the other hand electric insulation between the rail and the support unit is also established.

According to one preferred embodiment the device has, furthermore, a rigid pressure distribution plate, preferably made of metal or some other bend-resistant material, which can be attached onto the threaded bolts of the support unit and is configured and has dimensions such that it extends into open receiving spaces of the angle guide elements facing towards one another. In this way the load acting on the rail is distributed via the rail foot over a larger area than the dimensions of the rail foot, and so the loads are introduced more evenly and with smaller local surface pressures into the substructure.

Depending on the desired application it can be advantageous to provide the pressure distribution plate, as viewed in the longitudinal direction of the rail to be mounted, with a cross-section which is wedge-shaped, at least in some areas. This measure serves to set specific rail cants.

In connection with this it is advantageous to level out the rail cant by the two angle guide elements of a mounting point having different heights. In this way, purely by choosing a wedge-shaped pressure distribution plate and by choosing angle guide elements adapted to the latter while using standard elements otherwise a desired rail cant can be established.

According to one preferred embodiment the device has, furthermore, an elastic intermediate plate between the pressure distribution plate and the support unit.

Further adaptability in relation to the precise track gauge consists either of using angle guide elements with different dimensions between the rail foot and the support elements, or providing a spacer plate between an angle guide element and the adjacent support element on one side or on both sides of the rail. These measures serve to enable precise adaptation of the track gauge.

Preferably the receiving space provided in the angle guide elements is formed by an open U profile in the pre-assembly position, and the clear height of this receiving space is greater than the overall thickness of the elastic intermediate layer and the rigid pressure distribution plate. This facilitates not only assembly, but ensures that the forces from the tensioning clamps acting on the angle guide elements are introduced by direct contact between the angle guide elements and the support unit into the support unit.

The device according to the invention can be used both on railroad sleepers in the turnout area and on carriers of a fixed track, and offers considerable advantages to the effect that the mounting system can be pre-assembled on the rail or point without a sleeper.

BRIEF DESCRIPTION OF THE FIGURES

In the following the invention will be described, purely as an example, by means of the attached figures which show as follows.

DETAILED DESCRIPTION OF EXEMPLARY EMBODIMENTS

In the following an embodiment of the invention will be described by means of FIGS. 1 to 3. Here the same components are respectively identified by the same reference numbers.

Figure 1:
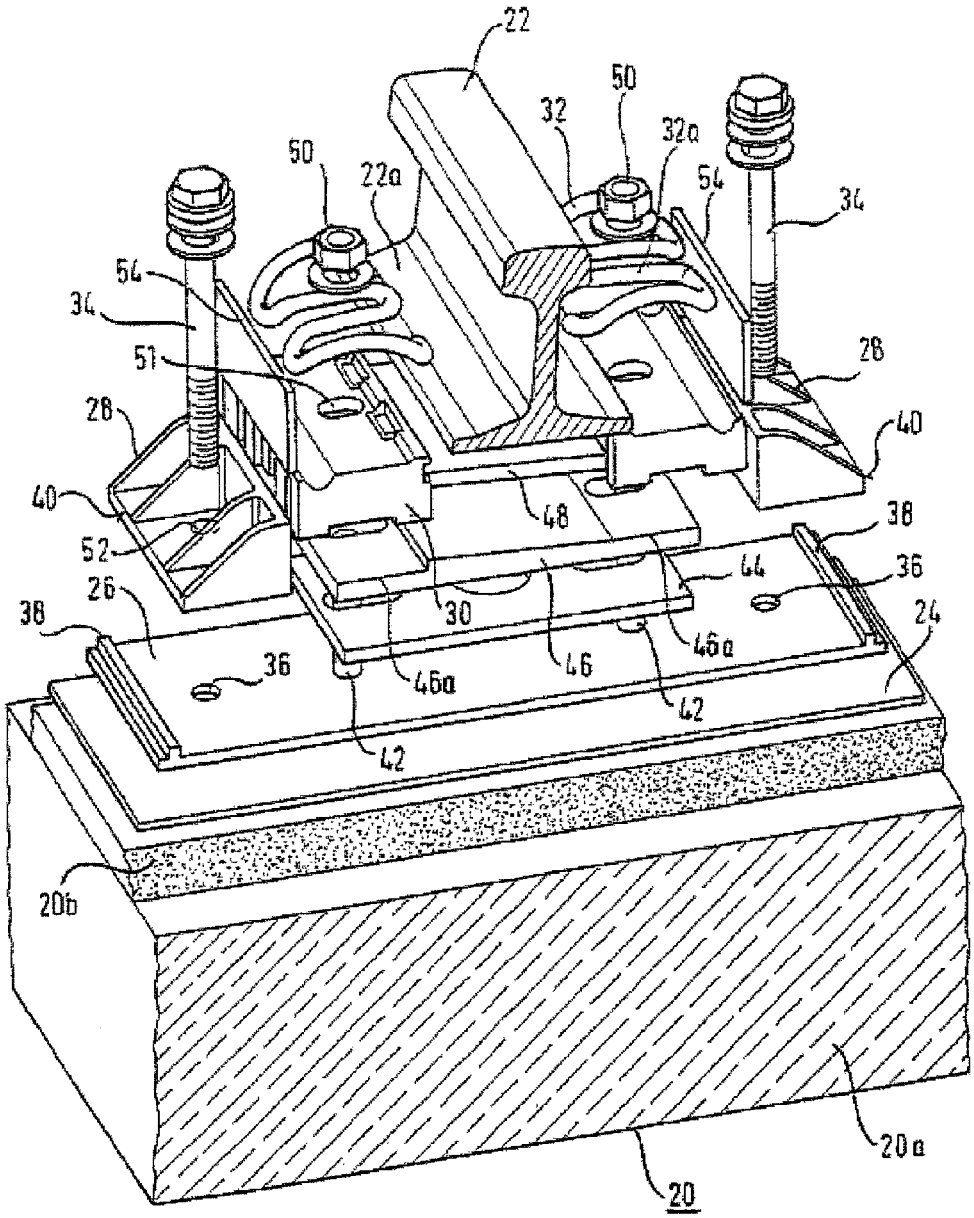
FIG. 1 an exploded view of the device according to the invention on a substructure.

The exploded view shown in FIG. 1 shows a substructure 20 the construction of which is not essential in order to understand the invention. This can be a sleeper in the turnout area or a fixed track with a first section 20*a* lying at the bottom and a bottom casting e.g. made of a quick-casting mortar disposed over the latter, which is suggestively identified by reference number 20*b*. In the same way, however, the substructure 20 can be a one-piece concrete sleeper. It is essential that the upper side of the substructure 20 facing towards the rail is not profiled. Bore holes and plugs introduced into the latter in the substructure for receiving the sleeper screws are not shown in the figures.

The assembly unit described below can be pre-assembled on the rail 22 so that after positioning the rail with the pre-assembled rail mounting unit only an electrically insulating intermediate layer can optionally also be disposed between the support unit 26 and the upper side of the substructure 20.

The pre-assembly unit already attachable to the rail 22 comprises a support unit 26, support elements 28, angle guide elements 30, tensioning clamps 32, sleeper screws 34 and various elements which can be disposed between the rail foot 22*a* and the support unit 26 and will be described later.

The support unit 26 is preferably a steel plate which has bore holes 36 through which the sleeper screws 34 or bolt connections pass and has ribs 38 extending in the longitudinal direction of the rail which in the installed position come into contact with bearing surfaces 40 of the support elements 28 and on the one hand prevent unintentional turning of the support elements 28, and on the other hand can also at least partially accommodate the transverse forces introduced by the rail 22 via the foot of the latter 22*a* into the angle guide element and the support elements. The embodiment shown in FIG. 1 with ribs passing through it is only to be taken as an example here. The ribs can in the same way be made up of a number of individual elevations provided the latter perform the aforementioned functions.

Threaded bolts 42 extend upwards from the support unit 26 perpendicularly to the planar extension of the support unit 26, i.e. in the direction of the angle guide plates in the installed position. The threaded bolts 42 can be welded here to the support unit 26 or be connected to the latter in some other way, or can be inserted from the lower side, i.e. the side facing towards the substructure, through through bore-holes of the support unit 26. In the case of separate provision of screws which are inserted from the lower side into the support unit 26, the use of countersink screws with a conical screw head which offers a high friction surface to the support unit, and moreover does not project over the lower side of the support unit 26 is recommended.

In the exemplary embodiment according to FIG. 1, within the framework of the pre-assembly an elastic intermediate layer 44 made of plastic is initially attached onto the threaded bolts, followed by a pressure distribution plate 46 made of metal and a second elastic intermediate layer 48 which has dimensions such that it is only located beneath the rail foot 22*a* or above the pressure distribution plate 46. Therefore the threaded bolts 42 extend from the support unit through the elastic intermediate layer 44 and the pressure distribution plate 46 and pass from here through an opening 51 into the respective angle guide elements 30. This can no longer be seen in the exploded view of FIG. 1, but is shown for example in FIG. 3. The threaded bolts 42 then pass through the central loops 32*a* of the W-shaped tensioning clamps 32, the arms of the central loops 32*a* respectively enclosing the threaded bolt tightly enough so that the tensioning clamps 32 can be fixed by screwing on the clamping nuts 50 and optionally an intermediate ring shown in the figures The elastic intermediate layer 44 and the pressure distribution plate 46 have dimensions such that they extend into U-shaped recesses of the angle guide elements 30 facing towards the rail foot 22*a* so that even in the case of a loose mounting of the clamping nut 50 onto the threaded bolt 42 the elastic intermediate layer 44 and the pressure distribution plate 46 are connected undetachably to the support unit 26.

The pressure distribution plate 46 shown in FIG. 1 has different areas, namely two side areas 46*a* respectively having the same height and a central area lying between these areas which in the example illustrated has a wedge-shaped cross-sectional form and serves to set a pre-defined rail cant.

There is disposed respectively on the sides of the angle guide elements 30 facing away from the rail foot 22*a* a support element 28 that has an angular cross-section which already has the aforementioned bearing surface 40 for resting against one rib 38 respectively of the support unit and a receiving opening 52 for the corresponding sleeper screw 34.

As can be seen in FIG. 1, a spacer plate 54 for setting the gauge can be located between the angle guide element 30 and the corresponding support element 28. These types of spacer plate 54 can be located on one side or on both sides of the rail, but it is also possible to bring about the same effect of graduated gauge setting by means of coordinated sets of angle guide elements.

Figure 4:
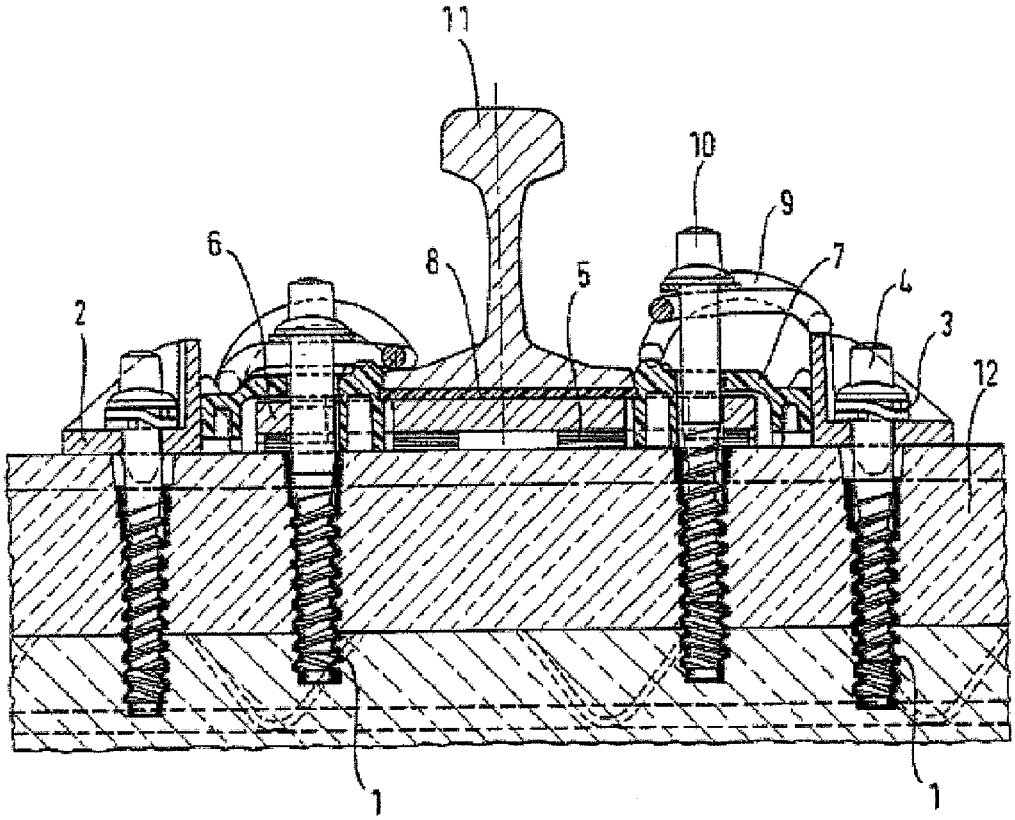
RELATED ART Fig. 4
FIG. 4 a sectional illustration of a mounting system in the prior art.
Figure 5:
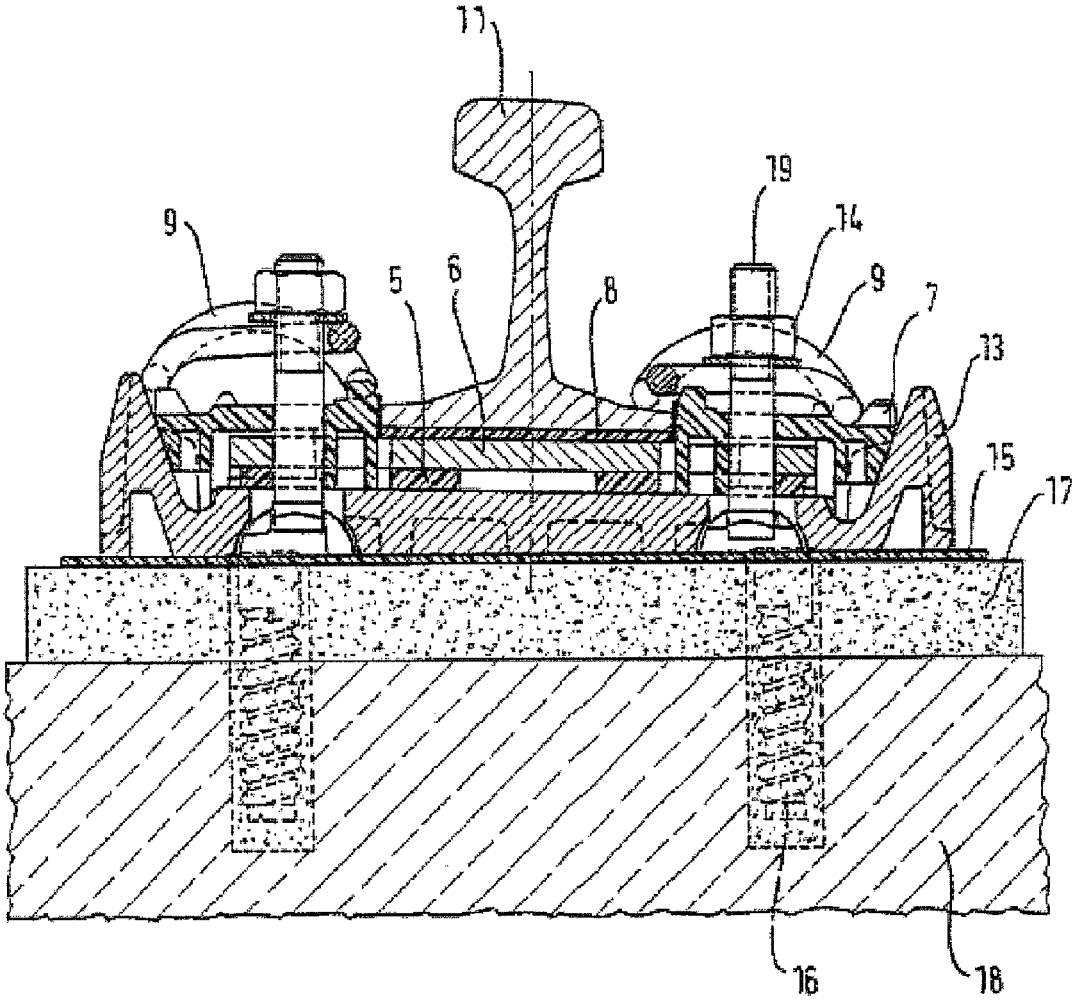
RELATED ART Fig. 5
FIG. 5 a sectional view of a further mounting system in the prior art.

The angle guide elements 30 are preferably produced from plastic, and the support elements 28 are preferably made of metal or plastic. As known in the prior art, the angle guide elements 30 are provided with bearing shoulders and indentations in order to be able to fix a corresponding tensioning clamp both in a pre-assembly position and an installed position, as can also be seen, for example, by means of the illustrations of the prior art in FIG. 4 and FIG. 5.

Figure 2:
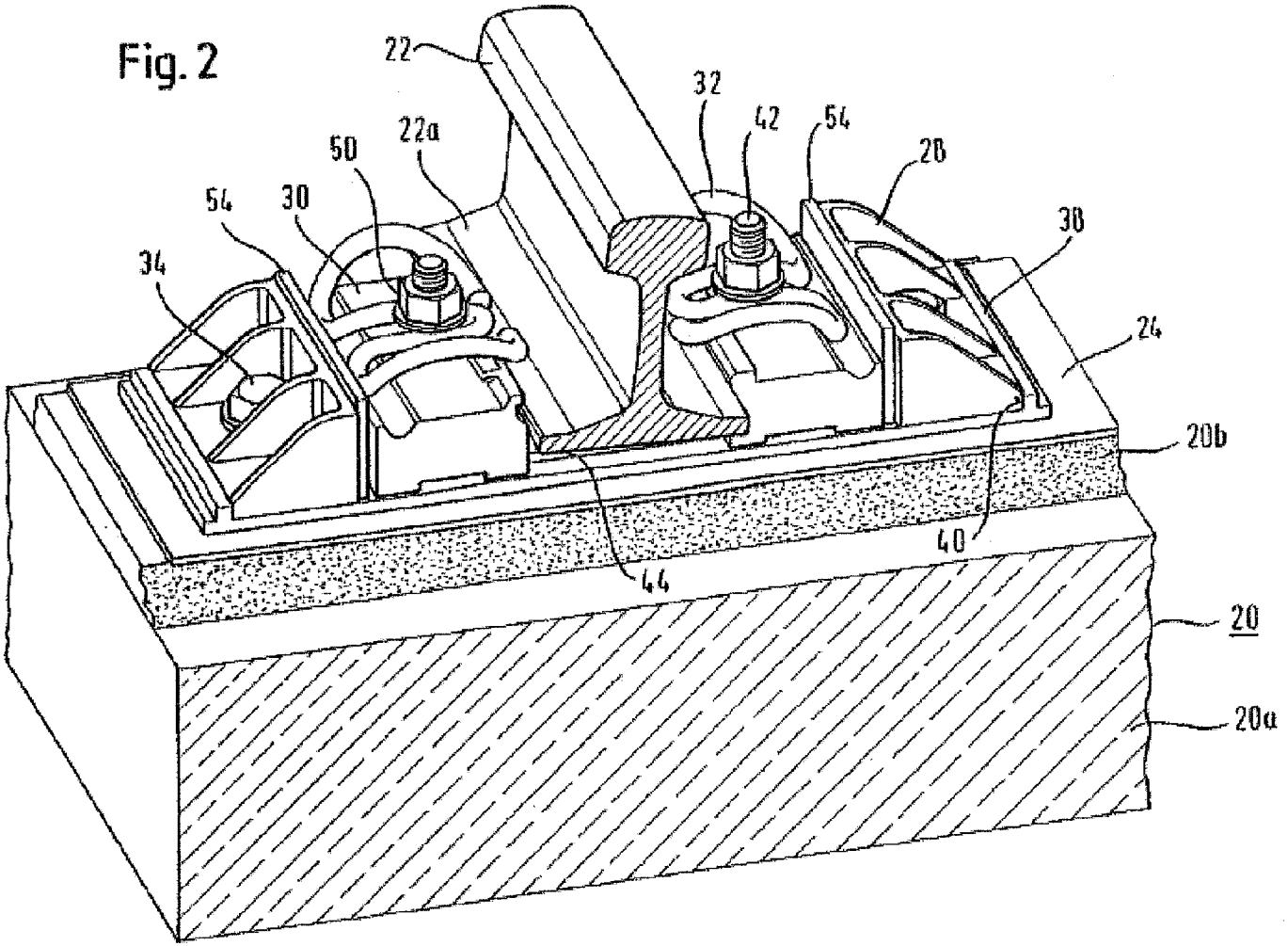
FIG. 2 the rail mounting illustrated in FIG. 1 in the installed state.

FIG. 2 shows the arrangement according to FIG. 1 in the installed position, it now becoming clear how the tensioning clamp 32 lies with its free spring ends on the rail foot 22*a* and on the other hand is supported in the indentation of the angle guide plate.

Figure 3:
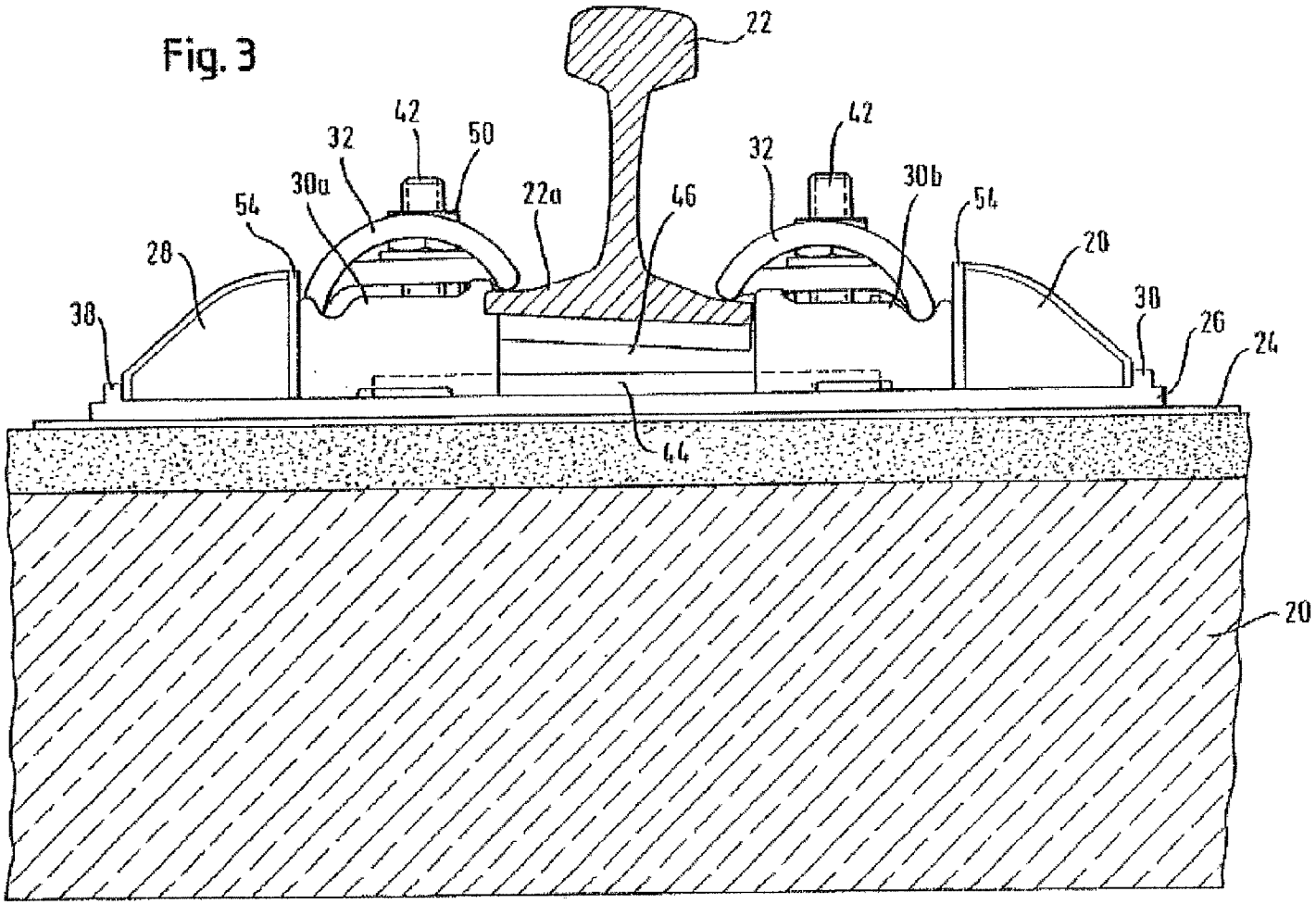
FIG. 3 a sectional view of the rail mounting shown in FIG. 2.

The illustration according to FIG. 3 makes it clear how on the one hand the elastic intermediate layer 44 extends into cavities of the angle guide elements 30. On the other hand however the wedge shape of the pressure distribution plate can also be seen in the central area from which the cant of the rail head evident in FIG. 3 results. It is also evident from FIG. 3 that the angle guide plates 30*a* and 30*b* have different dimensions so as to bring the tensioning clamps 32 respectively to the height suitable for fixing the rail foot when the rail foot 22*a* is inclined. Correspondingly, the threaded bolts 42 also have dimensions which are sufficient to be able to accommodate the desired thickness of elastic intermediate layers and the required rail cant. Since the pressure distribution plate made of steel also serves to regulate the height, the normal thickness variation of the latter is also to be taken into consideration when designing the length of the threaded bolts.

The advantage of the solution according to the invention is that the whole assembly illustrated in FIG. 3 starting from the support unit 26 to the rail 22 can be pre-assembled, and only after being placed onto the substructure 20, optionally providing an intermediate layer 24, the sleeper screws 34 (not shown in FIG. 3) connecting this whole assembly securely to the substructure 20. In addition the support elements can be connected to the support unit by a clip connection not shown in the figures. In this way the assembly complexity is considerably reduced.

The above description of various embodiments has been given by way of example. From the disclosure given, those skilled in the art will not only understand the present invention and its attendant advantages, but will also find apparent various changes and modifications to the structures disclosed. The applicant seeks, therefore, to cover all such changes and modifications as fall within the spirit and scope of the invention, as defined by the appended claims, and equivalents thereof.

The invention claimed is:

1. A device for mounting railroad tracks on a substructure, each mounting point comprising:

two angle guide elements which are disposed respectively on either side of a rail foot;

a respective support element on a side of each angle guide element facing away from the rail foot;

two threaded bolts for tightening tensioning clamps which are arranged such that in an installed state they extend through openings in the angle guide elements;

a support unit which is disposed beneath the angle guide elements and the support elements of the mounting point; and a spacer plate between a respective one of the angle guide elements and the support element adjacent to the respective angle guide element.

2. The device according to claim 1, wherein the tensioning clamps are each substantially W-shaped, to form a respective central loop which partially surrounds a respective shaft of the threaded bolt and rests against the angle guide element.

3. The device according to claim 1, further comprising two sleeper screws or bolt connections which respectively pass through one of the support elements and through a through-hole in the support unit.

4. The device according to claim 1, wherein the support elements have a mounting contour, which interacts with a complementarily formed attachment contour of the support unit in order to attach the support elements to the support unit in a pre-assembly position.

5. The device according to claim 4, wherein the mounting contour is a clip mechanism.

6. The device according to claim 1, wherein the threaded bolts are securely connected to the support unit.

7. The device according to claim 6, wherein the threaded bolts are welded to the support unit.

8. The device according to claim 1, wherein the threaded bolts are countersink screws inserted into the support unit from the side facing away from the angle guide elements in the installed position.

9. The device according to claim 8, wherein the threaded bolts are assembled with the support unit to form one unit.

10. The device according to claim 1, further comprising at least one elastic intermediate layer arranged between the angle guide elements and configured to bear the rail.

11. A railroad sleeper configured for use in a turnout area comprising the device for mounting railroad tracks according to claim 1.

12. A fixed track for a section of railroad comprising carriers having at least one device for mounting railroad tracks according to claim 1.

13. A device for mounting railroad tracks on a substructure, each mounting point comprising:

two angle guide elements which are disposed respectively on either side of a rail foot;

a respective support element on a side of each angle guide element facing away from the rail foot;

two threaded bolts for tightening tensioning clamps which are arranged such that in an installed state they extend through openings in the angle guide elements;

a support unit which is disposed beneath the angle guide elements and the support elements of the mounting point; and projections on the support unit which in the installed state extend upwards and have locating surfaces configured to rest against counter surfaces of the support elements on the respective sides of the support elements facing towards the angle guide element.

* * * * *